United States Patent [19]

Jacobsson et al.

[11] 4,318,285

[45] Mar. 9, 1982

[54] APPARATUS FOR THE POSITIVE DELIVERY OF THREAD TO CIRCULAR KNITTING MACHINES

[75] Inventors: Kurt A. G. Jacobsson, Ulricehamn; Egon Johansson, Asunden, both of Sweden

[73] Assignee: Aktiebolaget IRO, Ulricehamn, Sweden

[21] Appl. No.: 51,188

[22] Filed: Jun. 22, 1979

[30] Foreign Application Priority Data

Jun. 28, 1978 [DE] Fed. Rep. of Germany ..... 2828427

[51] Int. Cl.[3] ..... D04B 15/48; D04B 35/14

[52] U.S. Cl. ..... 66/132 T; 66/163; 242/47.01

[58] Field of Search ..... 66/132 T, 132 R, 161, 66/163; 242/47.01

[56] References Cited

U.S. PATENT DOCUMENTS

| | | | |
|---|---|---|---|
| 3,264,845 | 8/1966 | Rosen | 66/132 T |
| 3,312,084 | 4/1967 | Sharp et al. | 66/163 |
| 3,490,710 | 1/1970 | Mühlhäusler | 242/47.01 |
| 3,686,613 | 8/1972 | Barski | 66/163 X |
| 3,747,864 | 7/1973 | Rosen | 242/47.01 |
| 3,785,176 | 1/1974 | Hebbecker et al. | 66/132 T |
| 3,802,228 | 4/1974 | Deniega | 66/132 T |
| 3,918,036 | 11/1975 | Jacobsson | 66/163 X |
| 3,950,966 | 4/1976 | DiCarlo | 242/47.01 X |
| 3,952,554 | 4/1976 | Kerff | 66/163 |
| 4,015,447 | 4/1977 | Philip | 66/132 R |
| 4,137,731 | 2/1979 | Jacobsson | 66/161 X |

FOREIGN PATENT DOCUMENTS 1129765 10/1968 United Kingdom ..... 66/163

*Primary Examiner*—Wm. Carter Reynolds

*Attorney, Agent, or Firm*—Blanchard, Flynn, Thiel, Boutell & Tanis

[57] ABSTRACT

An apparatus for the positive delivery of thread to a circular knitting machine having a plurality of movable belts which are positioned at different heights. A plurality of conveyor rollers are associated with the belts and are supported on a machine support ring. A plurality of cut-off devices individually coact with the conveyor rollers and, when the thread tension lessens, move the respective thread from its conveying position, in which it is movably clamped between one of the belts and its respective conveyor roller, into a rest position in which the thread lies outside of the belt. A number of the conveyor rollers, each of which corresponds with one of the belts, are individually rotatably but coaxially supported about a common axis defined by a support which projects from a holder, which holder is secured to the support ring. An elongated guide bar is also secured to the holder in sidewardly spaced but parallel relationship with respect to the common axis. This guide bar supports thereon a plurality of cut-off devices which are individually elevationally adjustable and are supported on the guide bar so as to be respectively associated with one of the conveyor rollers. The cut-off devices are structural units which are independent from the conveyor rollers.

10 Claims, 4 Drawing Figures

FIG. 3
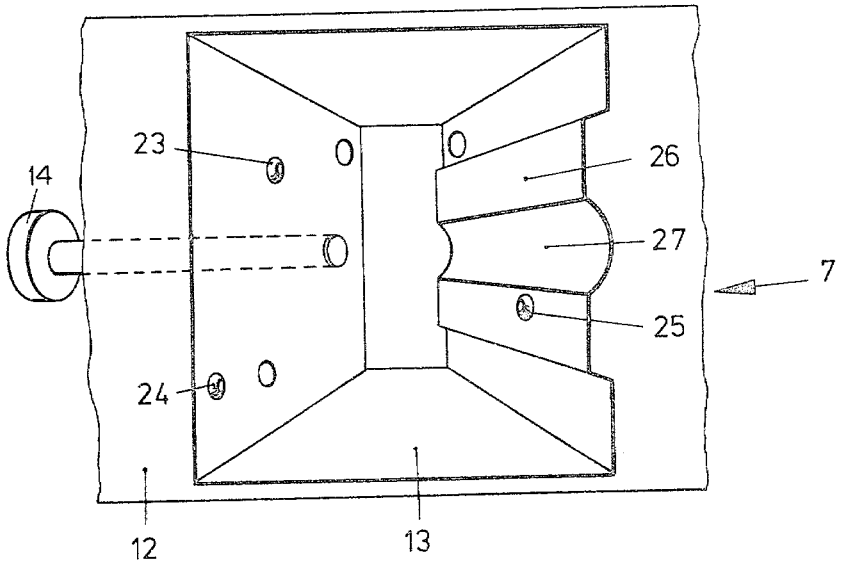
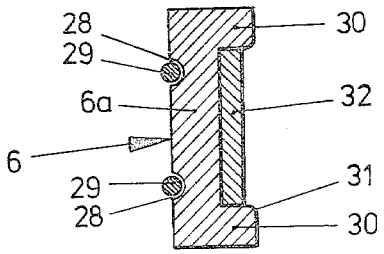
FIG. 2
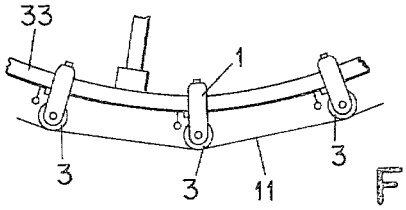
FIG. 4

APPARATUS FOR THE POSITIVE DELIVERY OF THREAD TO CIRCULAR KNITTING MACHINES

FIELD OF THE INVENTION

The invention relates to an apparatus for the positive delivery of thread to circular knitting machines.

BACKGROUND OF THE INVENTION

In circular knitting machines, the thread-delivery system has two or more belts, and two arrangements for the thread-delivery rollers and the associated cut-off devices are presently known.

In the one known arrangement U.S. Pat. No. 3,264,845, the delivery roller and the cut-off device are connected as one structural unit. The cut-off device has a cylindrical housing, which is arranged coaxially with respect to the thread-delivery roller and is connected to same. However, the unitary thread-delivery roller—cut-off device has a high height, so that the thread-delivery system occupies much space in the vertical direction. This is particularly true when the thread-delivery roller—cut-off device—units are each supported on separate support rings. However, the same problem will occur in a slightly lesser degree even when the thread-delivery rollers are supported with the cut-off devices which are connected to them on vertical posts, which are all mounted on a common support ring (U.S. Pat. No. 3,785,176). In the latter case each post carries only one thread-delivery roller with associated cut-off device. Idling rollers are arranged on a post which is parallel thereto for the belts which are not in contact with thread-delivery rollers. This arrangement has, as mentioned, as regards height, a slightly lesser need for space; however, it is difficult to store sufficient thread-delivery units in the peripheral direction of the machine, when dealing with a multi-system circular knitting machine.

The other known arrangement consists in supporting the thread-delivery rollers alone on vertical posts which are held by only one single support ring and to mount cut-off devices, which are structurally totally separate from said rollers, on a further support ring, which is provided below the aforementioned support ring. The space separation of the cut-off devices from the thread-delivery rollers has the great disadvantage that during stopping, the thread cannot be moved out of its clamped position between the belts and the thread-delivery rollers. Due to the inertia of the machine during stopping, after the switching-off time, still a large amount of thread is delivered, which can result in complications when the machine starts again.

The basic purpose of this invention is to produce an apparatus of the above-discussed type which permits a compact and space-saving arrangement of the thread-delivery rollers and of the cut-off devices while maintaining the advantages of a moving out of the thread from the clamping position during stopping.

This purpose is attained by the invention as defined in the attached claims.

In the case of the inventive apparatus it is possible to support a number of thread rollers, equal to the number of belts as exist on the machine, one above the other on a center support shaft. Since only the structural height of the thread-delivery rollers themselves is to be absorbed, the need for space in the elevational direction is small. The cut-off devices are supported as separate structural units on a guide bar which is parallel with respect to the shaft. As many cut-off devices are mounted on the guide bar as thread-delivery rollers are provided. Due to the narrow space and close association of the cut-off devices and the thread-delivery rollers, it is possible to maintain the function of moving the thread out from the belt during stopping. The guide bar extends near the shaft and the thread-guiding rollers and the cut-off devices are arranged closely side-by-side. This makes the entire apparatus extremely compact. By moving the cut-off devices on the guide bar, the moving-out function can be adjusted simply. Thus an apparatus is created which permits, in multi-system circular knitting machines, storage of the entire thread-delivery system in the smallest space.

It is already known to support on a vertical post, which is held on a support ring by clampable brackets, thread-delivery rollers and idling rollers and to arrange by means of a further bracket which projects in the other direction a cut-off device approximately at the same height as the thread-delivery roller. This cut-off device forms its own structural unit which is totally independent from the thread-delivery roller and which does not effect a moving of the thread out of the clamping position during stopping. Furthermore, with this system it is possible to provide only one cut-off device, so that an arrangement of several thread-conveying rollers one above the other on the same post and associated with cut-off devices which lie at the same level is not possible (Terrot-brochure).

The guide bar of this invention can be advantageously arranged radially inwardly of the respective support shaft as viewed relative to the support ring of the knitting machine. This results in an advantageous thread delivery and removal. The space which is available on the periphery of the support ring is utilized to an optimum.

In a preferred embodiment the guide bar is constructed as an electrically insulative member with electrically conductive paths in the longitudinal direction thereof, and each cut-off device has sliding contacts on walls of a guide groove which grips around the guide bar. The guide bar thus performs a second function. It eliminates the need for additional electrical lines to and from the cut-off devices. The entire structure becomes simpler and thus also less susceptible to breakdown. The electrical current connection of each cut-off device is without problems and is created independently from the respective adjusted height.

The insulating member of the guide bar can advantageously form a long narrow rectangle in cross section with two recesses which are arranged spaced from one another and which define parallel longitudinal grooves on one longitudinal side, and with projecting edge strips on the other longitudinal side. The edge strips have on their free ends inwardly projecting noses. Electrically conductive bars are supported in the longitudinal grooves and between the edge strips. Three conductive paths to the cut-off devices, which paths are independent from one another, are thus obtained on the surface of the guide bar. These paths can be used for the current supply and for transmitting of signals, i.e. switching functions. At the same time the narrow bar shape, which is advantageous for the longitudinal movement of the cut-off device, is maintained, so that the associated open or closed guide groove on the cut-off device does not unfavorably influence its structural size. The guide bar can be manufactured in an economical manner: either the conducting paths can be cast or sprayed in directly during the manufacture of the insulating member, or can be fixedly engaged in the provided recesses or between the noses of the edge strips.

The conductive bars can be connected in a simple manner to an electrical supply line which extends in the area of the support ring such that the conductive bars have, on their ends which are near the support ring, bent contact edges which project approximately horizontally from the insulating member. During attaching of the holder on the support ring, the contact edges can directly pierce through the insulation of a supply line and create the desired contact.

BRIEF DESCRIPTION OF THE DRAWINGS

One exemplary embodiment of the invention is illustrated in the drawings, in which:

FIG. 2 is a cross-sectional view of a guide bar,

FIG. 3 illustrates perspectively a guide groove of a cut-off device, and

FIG. 4 is a fragmentary top view showing several apparatus mounted on a conventional support ring.

DETAILED DESCRIPTION OF THE DRAWINGS

Figure 1:
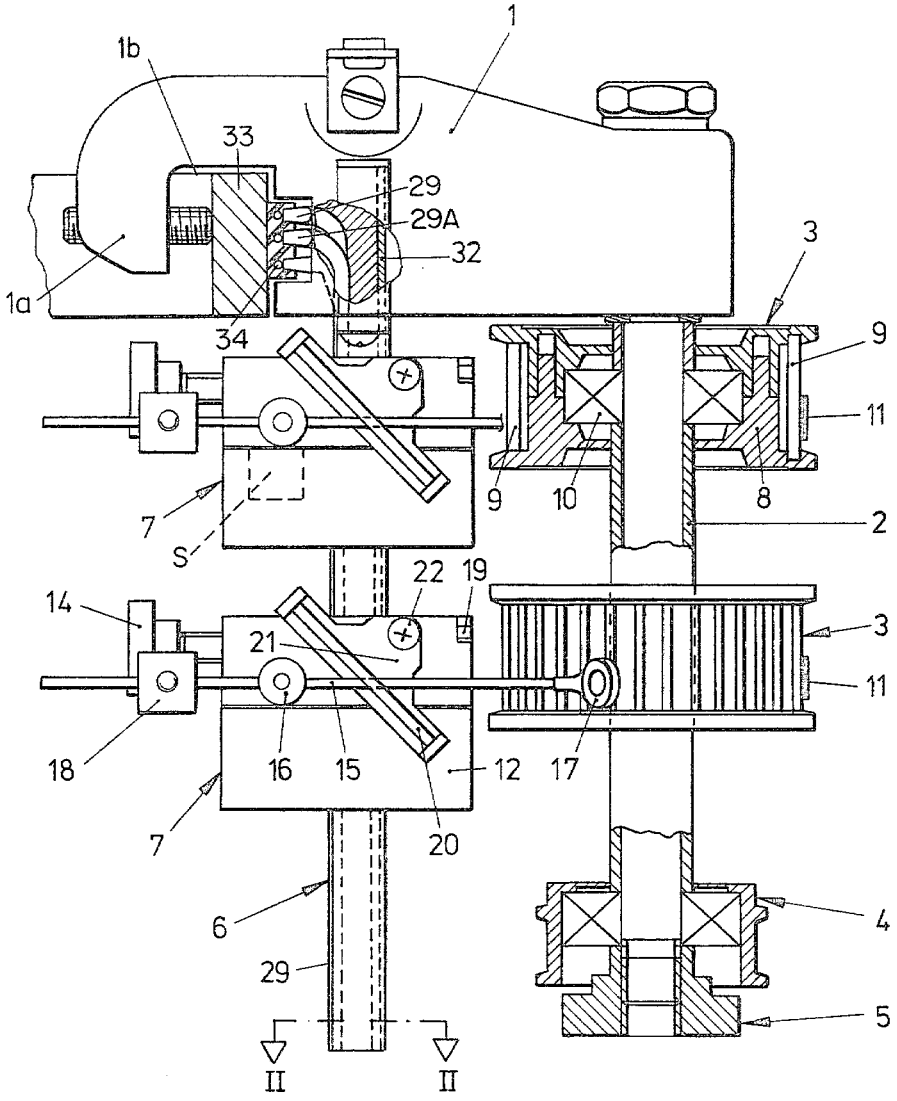
FIG. 1 is a partially cross-sectional view of an apparatus.

The apparatus which is illustrated in FIG. 1 for the positive delivery of thread to circular knitting machines has a holder 1 with a fastening bar 1*a* for mounting to a support ring 33, which ring fits within the recess 1*b* on the holder 1. As is conventional, ring 33 has electrical conductors 34 running therealong. One embodiment of this conventional support ring is illustrated and described in U.S. Pat. No. 3,747,864. A shaft 2 is arranged on the holder 1, on which shaft there are rotatably and coaxially supported two guide rollers, identified as a whole with reference numeral 3, and one idling roller 4. The shaft 2 has at its lower end a lock nut 5.

A guide bar which as a whole is identified with reference numeral 6 is secured on the holder 1 so that it is parallel but sidewardly spaced with respect to the shaft 2 whereby, when viewed with respect to the support ring 33, it is arranged radially inwardly of the shaft 2. Two cut-off devices which as a whole are identified with reference numeral 7 are moved onto the guide bar 6 and are secured thereon.

Each guide roller 3 is constructed as a rod cage with a two-part support member 8, in which the rods 9 are mounted. The support member 8 is rotatably supported on the shaft 2 by means of a ball bearing 10. The rods 9 of each guide roller form, together with a driven belt 11 which is indicated only in cross section in the drawing, the conveyor mechanism for a thread (not shown) which, when clamped between the rods 9 and the belt 11, is moved by the movement of the belt. The idling roller 4 serves as a support for a further belt (not shown) which has no conveying purpose on this apparatus but, however, runs on different apparatus of the circular knitting machine over a conveyor roller which is arranged at a corresponding level.

Each cut-off device 7 has a box-shaped housing 12 with a closed guide groove 13 (FIG. 3) extending therethrough. The guide groove 13 is of a cross section so as to slidably accommodate the guide bar 6 such that the cut-off device can be moved onto the guide bar and is movable thereon. A locking screw 14 is supported on the housing 12 so that it can be rotated into the guide groove 13 to engage the guide bar 6 to lock the housing 12 thereto. Swivel arms 15 are rotatably supported about a common, through-going swivel axis 16 on both sides of the housing 12. The arms 15 extend on both sides of the respective guide roller 3 and each arm carries at its free end a thread eyelet 17. One of the two swivel arms 15 has at the other end an adjustable weight 18. A stop 19 for the swivel arm is furthermore mounted on the housing 12 with a locking point for locking the arms. A guide member 20 for the thread is furthermore mounted pivotally about a pivot bearing 22 by means of a support plate 21 on one side of the housing 12. This guide member 20 defines thereunder an elongated slot for loosely confining and guiding the thread which is supplied from a supply spool (not shown) in the vicinity of the roller 3 so that the thread will properly pass through the eyelet of the swivel arm 15. For convenience, the swivel arm 15 also passes through the loop or slot defined by the guide member 20, but the guide member 20 does not restrict the motion of arm 15.

Switching means, indicated only diagrammatically at S, for turning off the conveyor belts 11 in the case of thread breakage and a signal lamp are arranged inside of the housing 12. The switch means is connected to contact means which includes sliding contacts 23, 24 and a grounding sliding contact 25 which project from the housing walls which define the guide groove 13. The grounding sliding contact 25 is arranged on a longitudinally extending projection 26 which projects into the guide groove 13. The projection 26 is divided into two webs by a center recess 27.

The guide bar 6 is illustrated in a cross-sectional view in FIG. 2. It has an electrical insulating member 6*a* of a substantially elongated rectangular cross section. The insulating member has on one broad side two longitudinal grooves 28, the walls of which corresponds in cross section approximately with a three-quarter circle. An elongated electrically conductive wire 29 of circular cross section is fixedly positioned within each said longitudinal groove 28. The transverse distance between the conductive wires or bars 29 corresponds with the transverse distance between the sliding contacts 23 and 24 on the cut-off device 7 so that the contacts engage these wires. The insulating member 6*a* has edge strips 30 on the opposite broad side. Each edge strip has in cross section an inwardly projecting nose 31, which results in an undercutting. A grounding bar 32 in the form of a flat rod is mounted on the surface of the insulating member 6*a* between the edge strips 30. The grounding bar 32 extends over the entire length of the guide bar 6 for engagement with contact 25. The conductive wires 29 are bent at their upper ends, namely in the area of the holder 1, at different levels, as shown in FIG. 1. The ends of wires 29 project from the holder 1 and are constructed as contact edges 29*a*, one for each wire 29 and one for grounding bar 32. When attaching the holder 1 onto the machine support ring 33, on which at a suitable level run electrical conductors or cables 34, the contact edges 29*a* penetrate through the insulation of said conductors and create the electrical contact with the circuits of the machine.

The described apparatus is used during operation to feed one or several threads through the cooperation of the guide rollers 3 with the associated belts 11 to the knitting machine. The thread runs through the thread eyelets 17 of the two swivel arms 15 of a cut-off device 7 and, due to its tension, maintains the swivel arms against the action of the weight 18 in a position in which the thread runs between the rods 9 of the guide roller 3 and the belt 11. In the case of a breakage of the thread or a different breakdown, which leads to a strong drop in the thread tension, the weight 18 swivels the swivel arms 15 such that the eyelets 17 are moved axially along the roller 3 away from the belt 11 so that the thread is pulled upwardly out from beneath the belt 11. With this the thread conveyance is stopped immediately and the machine stops, even if the conveyor mechanism continues to run after such stopping, because the machine and thus the belt drive continues to run a little longer due to inertia. The turning-off of the machine occurs due to the upward swinging of arms 15 which activate the limit switches mounted within the housing 12 of the respective cut-off device 7, which switches are connected to the machine circuits through the contacts 23–25 and conductors 29 and 32. Furthermore, a signal lamp lights up in the cut-off device, which lamp can be recognized through the partially transparent housing 12. The elevational adjustability of the cut-off devices 7 on the guide bar 6 permits each conveyor roller 3 which is necessary for the respective manufacturing process to be associated with a cut-off device 7 at a suitable level.

The invention is not limited to the exemplary embodiment. Thus, the number of guide rollers and/or idling rollers, which are arranged on a common support shaft, may be any selected number, just like the number of associated cut-off devices.

The cross sections of the guide bar and of the guide grooves on the cut-off devices are also variable while maintaining their effect. This is also true for the cross sections of the conducting members which are embedded in the guide bar or are mounted on same.

What is claimed is:

1. In an apparatus for the positive delivery of thread to a circular knitting machine having a plurality of movable belts which are positioned at different heights, said apparatus including a plurality of conveyor rollers which are associated with the belts and are supported on a machine support ring by means of a holder, and a plurality of cut-off devices which, when the thread tension lessens, moves the respective thread from its conveying position, in which it is movably clamped between one of the belts and its respective conveyor rollers, into a rest position, in which it lies outside of the belt, comprising the improvement wherein a number of said conveyor rollers corresponding to a number of said belts are individually but coaxially rotatably supported about a common axis defined by a support which is mounted on and projects from the holder, and an elongated guide bar is secured on the holder sidewardly spaced from but parallel with respect to said axis, said guide bar having electrically conductive means extending therealong and adapted for connection with electrical power means associated with the support ring when the holder is mounted thereon, said guide bar supporting thereon a number of said cut-off devices which are elevationally adjustable and which are respectively associated with the conveyor rollers, the cut-off devices being individual structural units which are independent from one another and are also independent from the conveyor rollers, and each said cut-off device having electrical contact means engageable with said conductive means.

2. An apparatus according to claim 1, wherein said machine support ring has electrical cable means extending therealong, said electrically conductive means including a pair of electrical conductors which are rigidly fixed to and extend along said guide bar, said electrical conductors having means associated with one end thereof for electrically contacting said electrical cable means when said holder is mounted on said ring, and the electrical contact means on each said cut-off device being automatically electrically engaged with said electrical conductors when said cut-off device is mounted on said guide bar.

3. An apparatus according to claim 2, wherein each said cut-off device includes a housing which is fixedly but removably attached to said guide bar, said housing having thread-engaging means movably supported thereon for controlling the positioning of said thread as it passes around the respective thread-conveying roller, each said housing also having switch means mounted thereon and activated by said thread-engaging means, said switch means being electrically connected to said electrical contact means, and said electrical contact means being associated with a surface of said housing so as to be automatically engageable with said pair of electrical conductors when said housing is mounted on said guide bar.

4. In an apparatus for the positive delivery of thread to a circular knitting machine having a plurality of movable belts which are positioned at different heights, said apparatus including a plurality of conveyor rollers which are associated with the belts and are supported on a machine support ring by means of a holder, and a plurality of cut-off devices which, when the thread tension lessens, moves the respective thread from its conveying position, in which it is movably clamped between one of the belts and its respective conveyor roller, into a rest position, in which it lies outside of the belt, comprising the improvement wherein a number of said conveyor rollers corresponding to a number of said belts are individually but coaxially rotatably supported about a common axis defined by a support which projects from the holder, and an elongated guide bar is secured on the holder sidewardly spaced from but parallel with respect to said axis, said guide bar supporting thereon a number of said cut-off devices which are elevationally adjustable and which are respectively associated with the conveyor rollers, the cut-off devices being structural units which are independent from the conveyor rollers, said guide bar being constructed as an electrically insulating member with electrically conductive paths which extend in the longitudinal direction thereof, and each cut-off device having sliding contacts on walls of a guide groove which grips around the guide bar.

5. Apparatus according to claim 4, in which the guide bar is arranged, relative to the axis of the support ring, radially inwardly with respect to the axis of said support.

6. Apparatus according to claim 4, wherein the insulating member forms in cross section a long narrow rectangle with two recesses which are arranged spaced from one another and define parallel longitudinal grooves along one longitudinal side thereof, and with projecting edge strips along the other longitudinal side thereof, and wherein one conductive bar is supported in each longitudinal groove and a grounding bar in the form of a flat rod is supported between the edge strips.

7. Apparatus according to claim 6, wherein the conductive bars have ends which are positioned near the support ring and which define contact edges which project approximately horizontally from the insulating member.

8. Apparatus according to claim 6, in which the conductive bars have a circular cross section and the longitudinal grooves have approximately a three-quarter circular cross section.

9. Apparatus according to claim 4, in which a guide bar for the thread is supported swingably on each cut-off device on one side surface thereof.

10. A thread delivery system for use in combination with a circular knitting machine having an encircling support ring and a plurality of movable belts which are positioned at different heights and which at least partially encircle the machine, said system including a plurality of thread-feed apparatus mountable on said support ring at spaced intervals therealong in encircling relationship to said machine, each said apparatus having a thread-conveying roller associated therewith and coacting with one of said belts, each said apparatus also having a cut-off device associated with the respective thread-conveying roller, the improvement wherein said apparatus comprises:

a holder stationarily but removably mountable on said support ring at a selected location, said holder comprising an elongated arm which is secured to the support ring and projects radially therefrom, an elongated support shaft fixed to and projecting substantially vertically from said arm, at least two said thread-conveying rollers being supported on said support shaft in vertically spaced relationship so that the rollers are disposed one above the other, each said roller being independently rotatably supported relative to said support shaft for rotation about the longitudinally extending axis thereof, each said thread-conveying roller also being positioned at a height corresponding to one of said movable belts so as to be engageable therewith whereby a thread can be suitably fed by being clampingly held between the roller and its respective belt, an elongated guide bar fixed to and projecting substantially vertically from said arm in substantially parallel relationship with but horizontally spaced from said support shaft, said support shaft and said guide bar being vertically elongated cantilevered elements which are secured to said arm at locations spaced radially from the support ring and which project vertically therefrom, said guide bar being positioned radially between the support ring and the support shaft, at least two said cut-off devices being individually removably mounted on said guide bar in vertically spaced relationship therealong so that one of said cut-off devices cooperates with a respective one of said thread-conveying rollers which is positionally adjacent and at a similar elevation, each said cut-off device being an independent structural unit which is separate from the other cut-off devices and is also separate from and independent of the thread-conveying rollers, each said cut-off device and said guide bar having structure cooperating therebetween for permitting the cut-off device to be elevationally adjusted relative to the guide bar and selectively stationarily secured with respect to the guide bar in a selected elevational position, each said cut-off device having thread-engaging means positioned adjacent the respective thread-conveying roller for engaging the thread which is engaged between the respective roller and its associated belt, the tension in said thread normally maintaining said thread-engaging means in a thread-conveying position, said cut-off device having means for urging the thread-engaging means into a rest position which is spaced away from the area of engagement between the belt and its respective roller in response to a reduction in the thread tension, said guide bar having a pair of electrically conductive elements fixed thereto and extending longitudinally thereof, and each said cut-off device including a pair of contacts which engage said conductive elements when said cut-off device is mounted on said guide bar.

* * * * *